US010775830B2

(12) United States Patent
Burchard et al.

(10) Patent No.: US 10,775,830 B2
(45) **Date of Patent: *Sep. 15, 2020**

(54) OPERATOR CONTROL APPARATUS

(71) Applicant: NBB Holding AG, Oelbronn-Duerrn (DE)

(72) Inventors: Thomas Burchard, Pforzheim (DE); Hans-Peter Bauer, Eisingen (DE)

(73) Assignee: NBB Holding AG, Oelbronn-Duerrn (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/288,405

(22) Filed: Feb. 28, 2019

(65) Prior Publication Data

US 2019/0258286 A1 Aug. 22, 2019

Related U.S. Application Data

(63) Continuation of application No. PCT/EP2017/070087, filed on Aug. 8, 2017.

(30) Foreign Application Priority Data

Sep. 9, 2016 (DE) ..... 10 2016 117 021

(51) Int. Cl.
*G05G 1/02* (2006.01)
*G05G 1/12* (2006.01)
(Continued)

(52) U.S. Cl.
CPC ..... *G05G 25/04* (2013.01); *B66C 13/40* (2013.01); *G05G 1/02* (2013.01); *G05G 1/12* (2013.01); *G05G 1/54* (2013.01)

(58) Field of Classification Search
CPC ..... F16K 37/0033; G05G 1/015; G05G 9/06; H01H 13/585
See application file for complete search history.

(56) References Cited

U.S. PATENT DOCUMENTS 3,718,786 A * 2/1973 Fila ..... H01H 13/585 200/419
3,743,806 A 7/1973 Fuller
(Continued)

FOREIGN PATENT DOCUMENTS

DE 224392 3/1909
DE 828875 12/1951
(Continued)

OTHER PUBLICATIONS

EPO Machine Translation of DE 10319180, Mersch et al., Nov. 25, 2004. (Year: 2004).*
(Continued)

*Primary Examiner* — Vinh Luong
(74) *Attorney, Agent, or Firm* — Lipsitz & McAllister, LLC

(57) ABSTRACT

An operator control apparatus, in particular a remote control apparatus is provided, comprising a splashproof housing and at least one operator control device which comprises an input assembly having a pushbutton head manually displaceable along a longitudinal axis, a rotary member rotatable about an axis of rotation and a coupling mechanism via which a linear movement of the pushbutton head is translatable into a rotary movement of the rotary member, wherein a signal transmitter is held to the rotary member in a rotationally fixed manner, which signal transmitter interacts with a sensor element arranged in the housing. In order to improve the operator control apparatus in such a manner that the input assembly may be mounted with ease and, if required, replaced with ease, the input assembly is insertable in a mounting direction into an exterior recess of the housing and is removable from the recess when required.

20 Claims, 6 Drawing Sheets

(51) Int. Cl.

| | |
|---|---|
| ***G05G 1/54*** | (2008.04) |
| ***G05G 25/04*** | (2006.01) |
| ***B66C 13/40*** | (2006.01) |

(56) References Cited

U.S. PATENT DOCUMENTS

| | | | | |
|---|---|---|---|---|
| 4,298,778 | A | 11/1981 | Beresford-Jones | |
| 4,317,392 | A | 3/1982 | Stephens et al. | |
| 4,322,711 | A | 3/1982 | Spangler et al. | |
| 4,758,692 | A | 7/1988 | Roeser et al. | |
| 5,041,705 | A * | 8/1991 | Piccoli | H01H 3/0226 200/52 R |
| 5,345,050 | A | 9/1994 | Branch et al. | |
| 5,665,947 | A * | 9/1997 | Falcon | H01H 3/0226 200/543 |
| 5,907,138 | A | 5/1999 | Metzler | |
| 6,501,458 | B2 * | 12/2002 | Baker | E02F 9/2004 345/161 |
| 7,030,331 | B2 | 4/2006 | Sasaki | |
| 8,207,805 | B2 * | 6/2012 | Wild | H01H 3/022 200/341 |
| 2005/0034966 | A1 | 2/2005 | Krebs et al. | |
| 2008/0165025 | A1 | 7/2008 | Morath | |
| 2011/0240447 | A1 | 10/2011 | Krebs et al. | |
| 2019/0258285 | A1 * | 8/2019 | Burchard | G05G 1/02 |

FOREIGN PATENT DOCUMENTS

| | | | |
|---|---|---|---|
| DE | 1165369 | | 5/1960 |
| DE | 1277982 | | 7/1966 |
| DE | 1924042 | | 2/1970 |
| DE | 2216634 | | 10/1973 |
| DE | 2853810 | | 12/1978 |
| DE | 3608569 | | 9/1987 |
| DE | 9407052 | | 8/1994 |
| DE | 4330502 | | 10/1994 |
| DE | 4412557 | | 10/1995 |
| DE | 19842806 | A1 * | 4/1999 |
| DE | 10304595 | B3 * | 7/2004 |
| DE | 10319180 | | 11/2004 |
| DE | 60104488 | | 12/2004 |
| DE | 10331130 | | 2/2005 |
| DE | 102004053033 | | 12/2005 |
| DE | 202006017729 | | 5/2008 |
| DE | 102006059822 | A1 * | 12/2008 |
| DE | 102007046512 | | 4/2009 |
| DE | 102008057993 | | 1/2010 |
| DE | 102010006826 | | 8/2011 |
| DE | 102012023806 | | 6/2014 |
| DE | 102014111715 | | 2/2016 |
| EP | 0365377 | | 4/1990 |
| EP | 2803888 | | 11/2014 |
| FR | 2604559 | | 4/1988 |
| GB | 1241548 | | 8/1971 |
| GB | 2001124 | | 1/1979 |

OTHER PUBLICATIONS

EPO Machine Translation of DE 102006059822, Bredow et al., Jun. 12, 2008. (Year: 2008).*

* cited by examiner

OPERATOR CONTROL APPARATUS

This application is a continuation of international application number PCT/EP2017/070087 filed on Aug. 8, 2017 and claims the benefit of German application number 10 2016 117 021.6 filed on Sep. 9, 2016, which are incorporated herein by reference in their entirety and for all purposes.

BACKGROUND OF THE INVENTION

The invention relates to an operator control apparatus, in particular a remote control apparatus, comprising a splashproof housing and at least one operator control device which comprises an input assembly having a pushbutton head manually movable along a longitudinal axis, a rotary member rotatable about an axis of rotation and a coupling mechanism, wherein by way of the coupling mechanism, a linear movement of the pushbutton head can be translated into a rotary movement of the rotary member and wherein a signal transmitter is held to the rotary member in a rotationally fixed manner, which signal transmitter interacts with a sensor element arranged in the housing.

Such operator control apparatuses are also referred to as manually actuatable control apparatuses and can be configured, for example, in the form of remote control apparatuses, in particular radio remote control apparatuses. Using such an operator control apparatus, the user can input a control command by actuating a pushbutton head, which control command can then be transmitted via a transmission channel to a technical device that is to be controlled. Transmission can be realized via a remote control line, in particular via a remote control wire, or also wirelessly, for example over an infrared link or a radio link.

Operator control apparatuses of the type mentioned at the outset are used, for example, as remote control apparatuses in forestry and construction technology, in particular for controlling cranes and hoisting devices. For the input of control commands, the operator control apparatuses have at least one operator control device comprising a pushbutton head that can be manually moved by the user along a longitudinal axis. The pushbutton head is coupled via a coupling mechanism to a rotary member that is rotatable about an axis of rotation, wherein a linear movement of the pushbutton head can be translated via the coupling mechanism into a rotary movement of the rotary member. Held to the rotary member, in a rotationally fixed manner, is a signal transmitter which interacts with a sensor element of the operator control apparatus. By actuation of the pushbutton head, the rotary member and therefore the signal transmitter can be caused to rotate and the rotary position and/or rotary position change of the signal transmitter can be detected by way of the sensor element. It is thereby rendered possible for the user to input control commands that depend on the movement of the pushbutton head.

Such operator control apparatuses, being in the form of remote control apparatuses in particular, are often used in harsh environments. The operator control apparatuses therefore comprise a splashproof housing in which control and transmission electronics are arranged. By way of the control and transmission electronics, the control command inputted by the user can be evaluated and a corresponding control signal can be transmitted, for example over radio link, to the device to be controlled, which may be, for example, a crane.

It is an object of the present invention to improve an operator control apparatus of the kind mentioned at the outset such that the at least one input assembly can be mounted with ease and can be replaced with ease.

SUMMARY OF THE INVENTION

This object is accomplished, in accordance with the invention, in an operator control apparatus of the generic kind in that the input assembly is insertable into an exterior recess of the housing of the operator control apparatus and is removable from the recess when required.

The splashproof housing of the operator control apparatus in accordance with the invention comprises a number of recesses corresponding to the number of input assemblies used so that each input assembly can be inserted in a mounting direction into an associated recess of the housing. The recesses are arranged on the exterior of the housing, for example on the upper side thereof. This facilitates mounting and replacement of the input assemblies, as it is not necessary to open the splashproof housing for inserting an input assembly into an exterior recess of the housing. If an input assembly is to be replaced, it can be removed from the recess, wherein replacement can be realized without the need to open the housing. In particular, replacement can be realized without risking damage to a seal of the housing.

It is advantageous for the input assembly to form a preassemblable constructional unit because this makes it possible for the input assembly to be inserted into a recess of the housing in the form of a constructional unit.

As mentioned at the outset, the rotary position and/or rotary position change of the signal transmitter can be detected by the associated sensor element so that the sensor element can provide to the control and transmission electronics of the operator control apparatus a sensor signal that depends on the rotary position and/or rotary position change of the signal transmitter.

The signal transmitter and the sensor element can interact in a contact-based manner. Thus, by way of example, provision may be made for the sensor element arranged in the housing of the operator control apparatus to be configured as a rotary potentiometer and for the signal transmitter arranged on the associated rotary member to be configured in the form of a driver which is in engagement with the rotary potentiometer.

It is particularly advantageous for the signal transmitter and the sensor element to interact in a contactless manner because this can prevent mechanical interference of the associated sensor element by the signal transmitter. The non-contact interaction between signal transmitter and sensor element is also advantageous in that the sensor element can detect the rotary position and/or the rotary position change of the signal transmitter even if a wall section of the housing of the operator control apparatus is arranged between the signal transmitter and the sensor element. The wall section can preferably be made of a plastics material that practically does not interfere with the detection of the rotary position and/or rotary position change by the sensor element. Non-contact interaction of the signal transmitter and the sensor element therefore allows the recess of the housing which receives the input assembly to be formed without the use of through-holes. Therefore, the signal transmitter, like the remaining constituent components of the input assembly, can be arranged completely on the exterior of the housing and need not, for instance, protrude into the interior of the housing. This facilitates mounting and replacement of the input assembly.

By way of example, provision may be made for the signal transmitter to be configured as a permanent magnet and for the sensor element associated with the signal transmitter to be sensitive to magnetic fields. By actuation of the pushbutton head of the input assembly, the rotary position of the permanent magnet arranged on the rotary member can be changed, and this in turn has as a consequence that the direction of the magnetic field generated by the permanent magnet changes. The change in direction can be detected by the magnetic field sensitive sensor element, which can then provide a corresponding sensor signal to the control and transmission electronics of the operator control apparatus.

Advantageously, the permanent magnet is magnetised in a direction transverse to the axis of rotation of the rotary member.

Preferably, the at least one operator control device comprises a connecting element engaging around the input assembly, which connecting element can be placed upon the input assembly and can be releasably connected, in particular screwably connected, to the housing.

The connecting element can engage behind the input assembly, relative to a mounting direction.

The input assembly can be inserted into an exterior recess of the housing, and the connecting element can be placed onto the input assembly and releasably connected to the housing so that the input assembly is fixed in the recess of the housing.

In an advantageous embodiment of the invention, the connecting element is configured in the manner of a union ring which is screwably connectable to the housing.

Preferably, the recess of the housing has a support surface and the input assembly comprises a support part which is supported on the support surface, preferably with a sealing element, such as a sealing ring, interposed therebetween. When the input assembly is inserted, the support part can rest on the support surface so that forces acting in a mounting direction on the support part can be accommodated by the support surface.

By way of example, the support surface can form a narrowing of the recess of the housing, in particular a step, via which the diameter of the recess is reduced.

It is advantageous for the rotary member and the signal transmitter held to the rotary member in a rotationally fixed manner to assume a distance from the housing so that the rotary movement of the rotary member and the signal transmitter is not interfered with by the housing.

Preferably, the support part forms a holder for the rotary member. With such a configuration of the invention, the support part not only has the function of supporting the input assembly on a support surface, but the support part also has a holding function for the rotary member. The rotary member is held to the support part in an axially non-movable and rotatable manner.

In an advantageous configuration of the invention, the support part comprises a guide sleeve to which the rotary member is rotatably held.

It is advantageous for the input assembly to comprise an elastically deformable cover part. The cover part can be configured in the form of a bellows, for example.

It is advantageous for the cover part to be formed from an elastically deformable plastics material.

In an advantageous configuration of the invention, the elastically deformable cover part engages underneath the pushbutton head which can be manually actuated by the user.

It is particularly advantageous for the pushbutton head to be connected to the cover part in a splashproof manner.

Advantageously, the axis of rotation of the rotary member is oriented collinearly to the longitudinal axis of the input assembly.

As has already been mentioned, a linear movement of the pushbutton head is translated via the coupling mechanism into a rotary movement of the rotary member. To this end, in an advantageous embodiment of the invention, the coupling mechanism comprises a plunger held to the pushbutton head, which plunger is coupled to the rotary member via a driver and a guide slot, wherein the driver enters the guide slot and wherein the guide slot, relative to the longitudinal axis, extends in the shape of a curve in an axial direction and in a circumferential direction. The plunger is connected to the pushbutton head and can be moved along the longitudinal axis together with the pushbutton head. The linear movement of the plunger is translated into a rotary movement of the rotary member via the driver and the guide slot which the driver enters.

The guide slot is configured in the shape of a curve in the manner of a helix and extends in both an axial direction and a circumferential direction. The driver and the guide slot thus form a control guide track which translates a linear movement into a rotary movement.

It is advantageous for the driver to be held to the plunger in a rotationally fixed manner and for the guide slot to be arranged on the rotary member.

By way of example, provision may be made for the driver to be configured in the form of a pin and to have at least one end thereof projecting radially from the plunger, wherein the projecting end thereof enters a guide slot of the rotary member.

It is advantageous for the driver to be configured as a driver pin which extends diametrically through the plunger and engages at each of its two ends in a guide slot of the rotary member.

Preferably, the at least one input assembly allows for stepless command input by the rotary position of the rotary member changing continuously depending on the extent of the stroke movement of the pushbutton head.

It is often helpful for the user to be provided with tactile feedback when one or more stroke positions of the pushbutton head have been reached, as this facilitates the handling of the operator control apparatus. To this end, the at least one input assembly in a preferred configuration of the invention comprises at least one latch element having a latch head which has associated therewith at least one latch depression which the latch head enters when a predetermined stroke position of the pushbutton head is reached. The entry of the latch head in a latch depression gives the user tactile feedback based on which he or she can be aware that the pushbutton head has reached a certain stroke position.

Preferably, the latch head is elastically biased in a direction towards the latch depression.

It is advantageous for the at least one latch element to have associated therewith a plurality of latch depressions arranged in a series one after the other relative to the longitudinal axis, which latch depressions the latch head of the latch element enters successively in a stroke movement of the pushbutton head. As the pushbutton head is moved along the longitudinal axis by the user, when predetermined stroke positions are reached, the latch head in each case enters a latch depression and thereby gives to the user tactile feedback on reaching the respective stroke position. This facilitates the handling of the operator control apparatus in particular in cases where the user operates the operator control apparatus with gloves on.

It is particularly advantageous for the at least one latch depression to be adapted to the shape of the latch head associated therewith. This provides a way for the contact of the latch head against the latch depression to be not only a point contact but a line or area contact. Wear on the at least one latch depression and the latch head can thereby be kept low.

In a preferred configuration of the invention, the at least one latch element has associated therewith a travel groove oriented parallel to the longitudinal axis, which travel groove the latch head of the latch element enters permanently, wherein the at least one latch depression associated with the latch element is arranged in the travel groove. The travel groove extends parallel to the longitudinal axis of the input assembly and upon movement of the pushbutton head, the latch head of the latch element associated with the travel groove slides along the travel groove. The latch head thus enters the travel groove permanently, independently of the stroke position of the pushbutton head. The at least one latch depression is arranged in the travel groove so that the latch head enters the latch depression when the pushbutton head has reached a predetermined stroke position.

It is advantageous for the shape of the travel groove to be adapted to the shape of the latch head entering the travel groove because this enables wear on the travel groove and the latch head to be kept low.

By way of example, provision may be made for the latch head to be of ball-shaped configuration and for the travel groove to have, relative to the longitudinal axis of the input assembly, a concave, circular arc shaped surface contour in a circumferential direction and, in an axial direction, an undulating surface contour comprising ridges and latch depressions which succeed each other in the axial direction and along which the latch head slides in line contact therewith when the pushbutton head is displaced and thereby provides to the user tactile feedback on reaching predetermined stroke positions when the pushbutton head is actuated.

In an advantageous embodiment of the invention, the input assembly comprises a latch member which is rigidly connected to the pushbutton head and which comprises at least one travel groove which is associated with a latch element and has at least one latch depression. The latch member can be moved together with the pushbutton head in an axial direction. It can comprise one or also more travel grooves, each of which is associated with a latch element held for non-displacement in an axial direction, the latch head of which latch element enters the travel groove permanently, independently of the stroke position of the pushbutton head.

Provision may be made for the latch member to be configured as a latch sleeve whose longitudinal axis is oriented coaxially with respect to the longitudinal axis of the input assembly and which carries on its exterior at least one travel groove having at least one latch depression and which is rigidly connected to a plunger which is itself rigidly connected to the pushbutton head. Thus, actuating the pushbutton head leads to a linear movement of the plunger and the latch sleeve and a latch head enters a latch depression when at least one predetermined stroke position of the pushbutton head is reached.

Advantageously, the input assembly comprises two latch elements in diametrically opposed relation to each other, which latch elements are aligned in line with each other and whose latch heads are biased radially in a direction towards the longitudinal axis of the input assembly by way of return springs. The two latch heads can receive between them a latch member rigidly connected to the pushbutton head, which latch member has on its exterior two travel grooves into each of which enters a latch head.

The following description of an advantageous embodiment of the invention, taken in conjunction with the drawings, serves to explain the invention in greater detail.

DETAILED DESCRIPTION OF THE INVENTION

Figure 1:
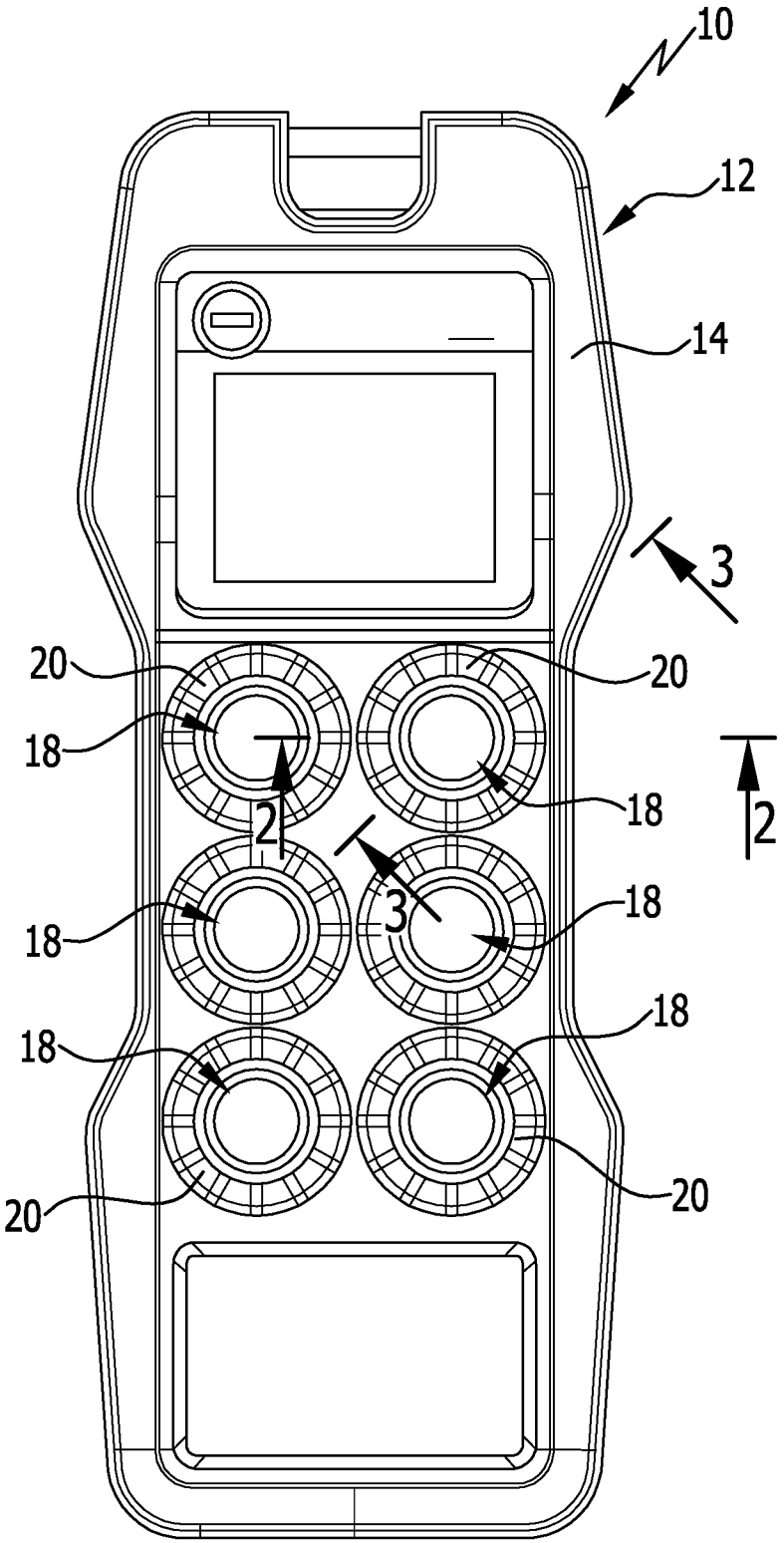
FIG. 1 is a top view illustrating an operator control apparatus in the form of a radio remote control apparatus having a plurality of operator control devices.
Figure 2:
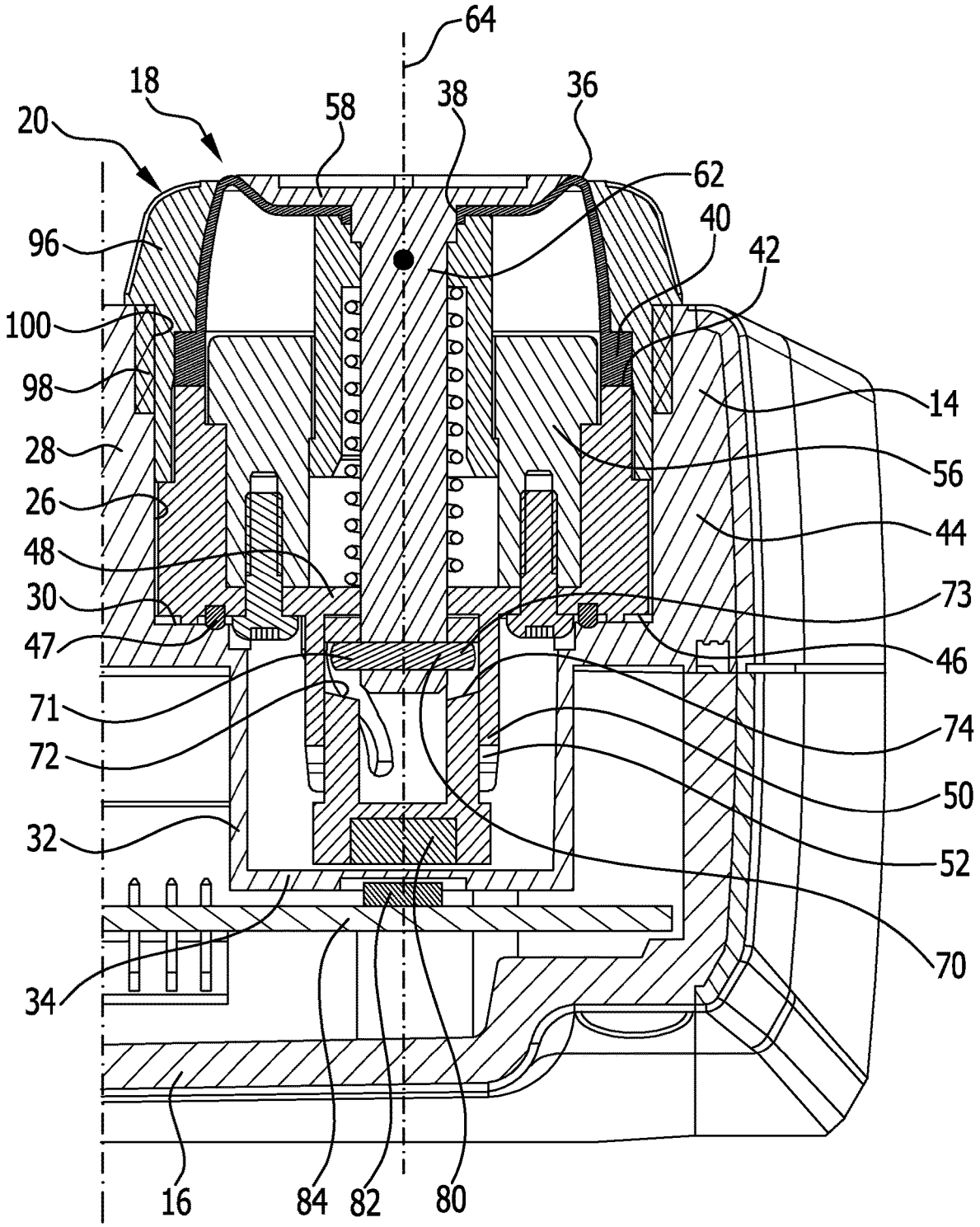
FIG. 2 shows an operator control device in a sectional view taken along line 2-2 of FIG. 1.
Figure 3:
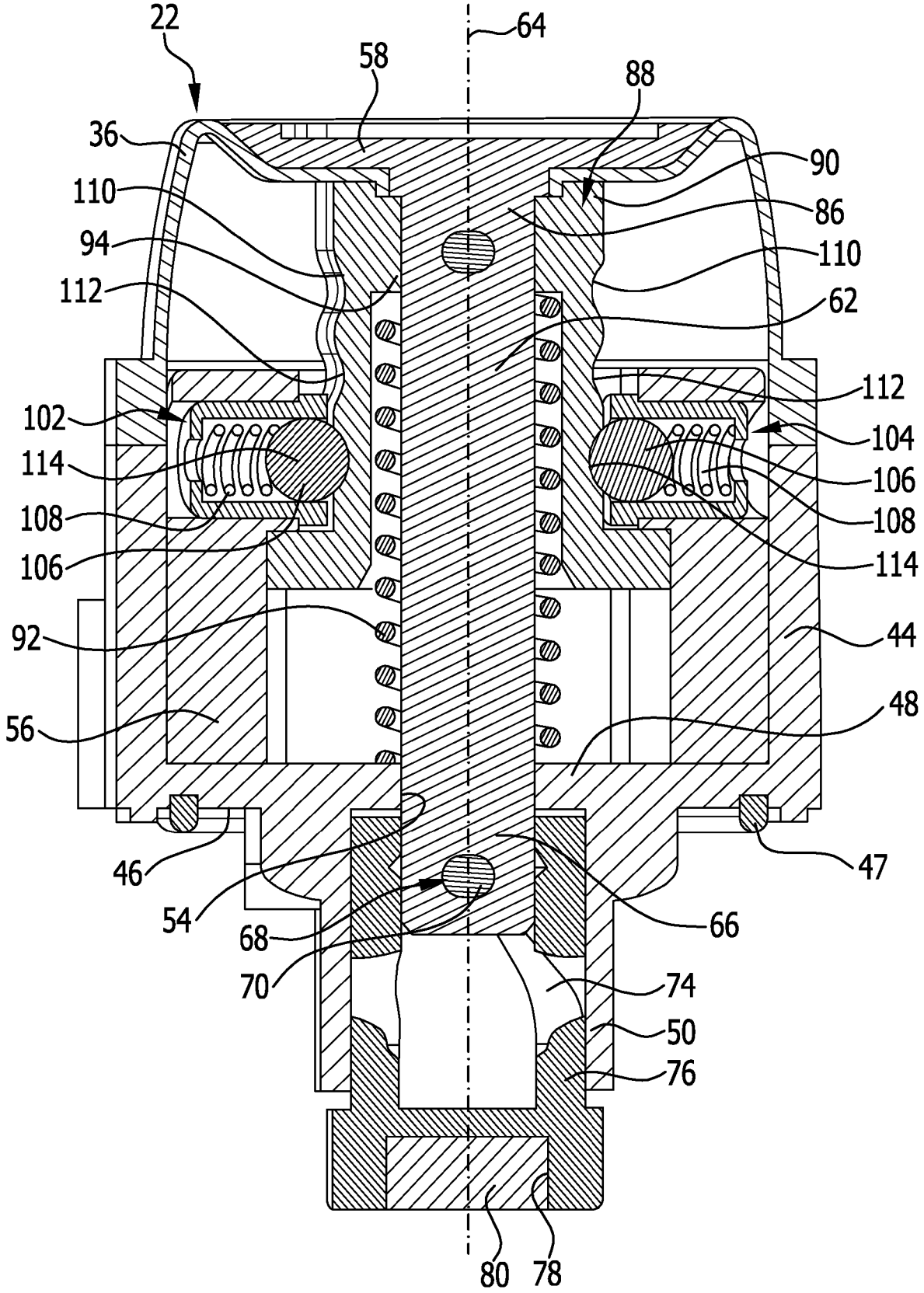
FIG. 3 shows the operator control device of FIG. 2 in a sectional view taken along line 3-3 of FIG. 1.
Figure 4:
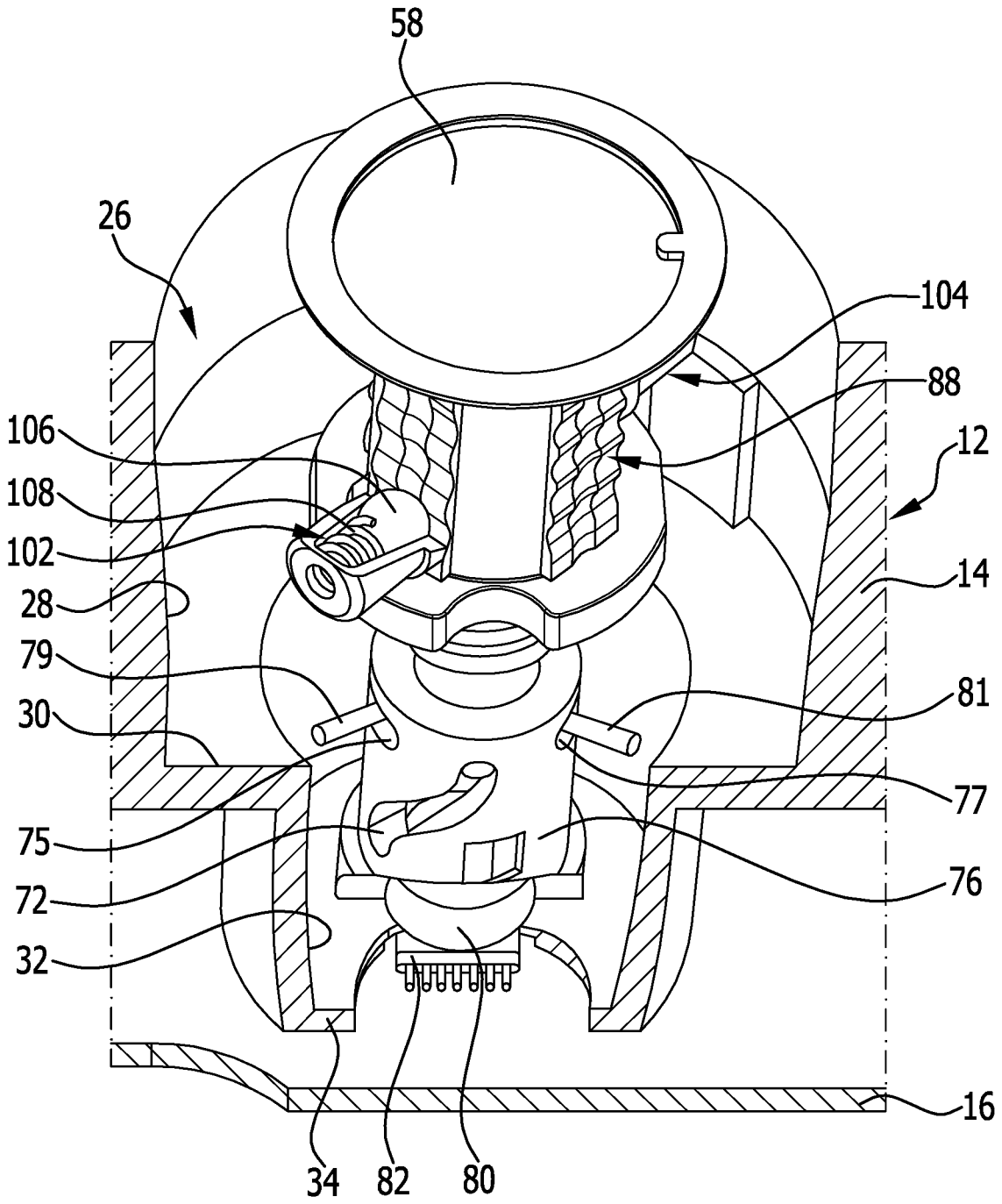
FIG. 4 is a perspective partial view of the operator control device of FIGS. 2 and 3.

The drawing shows a schematic representation of an advantageous embodiment of an operator control apparatus in accordance with the invention, generally designated by the reference numeral 10. The operator control apparatus 10 in the illustrated embodiment forms a radio remote control apparatus and comprises a housing 12 having a housing upper part 14 and a housing lower part 16 which are connected together in a splashproof manner. Received in the housing 12 are control and transmission electronics, known per se and not shown in the drawing in the interest of clarity, for generating and transmitting a control signal to a device that is to be controlled, such as a crane or a hoisting device.

Figure 7:
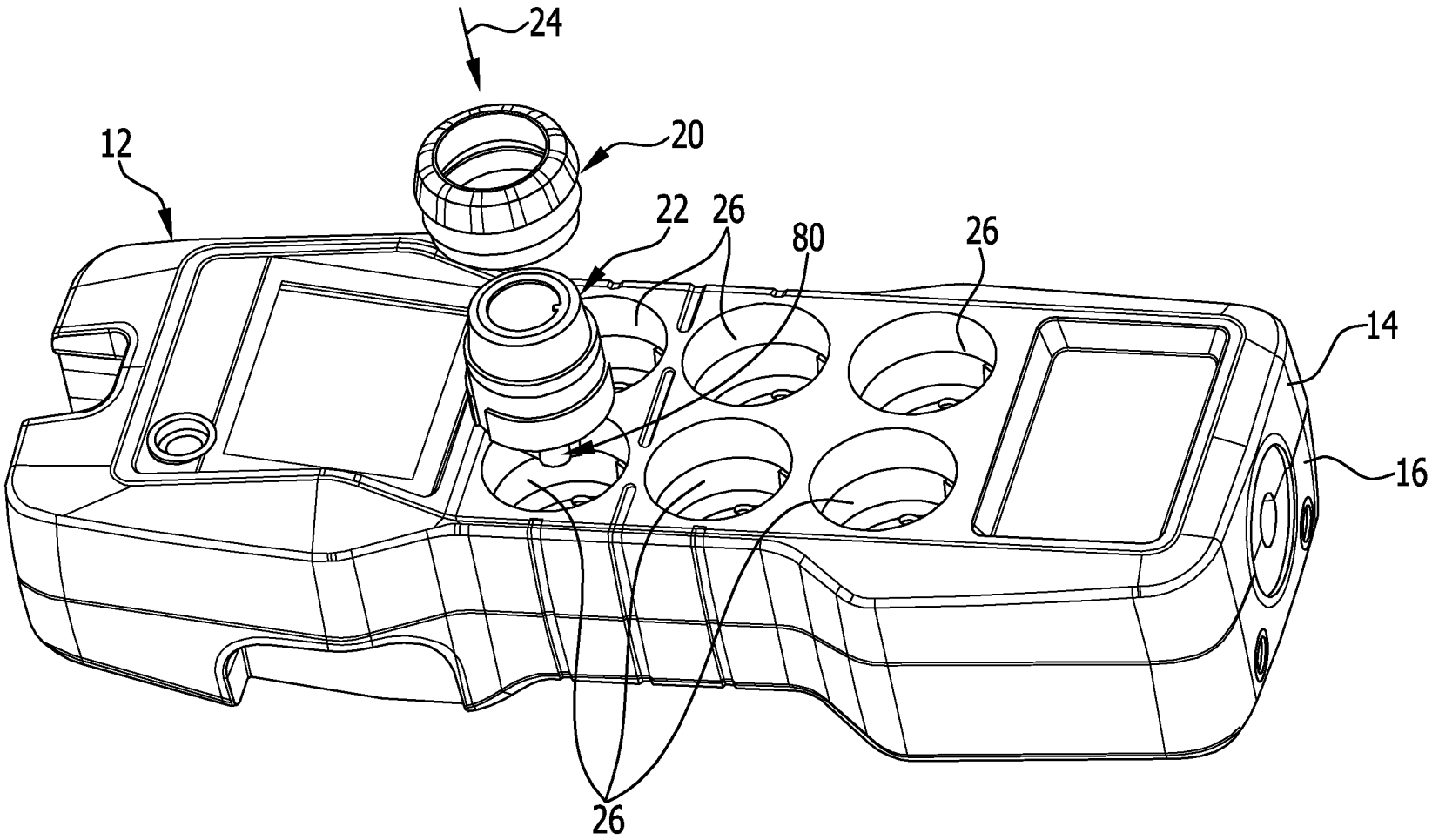
FIG. 7 illustrates an operator control device being mounted to a housing of the remote control apparatus of FIG. 1.

Arranged on the housing upper part 14 are a plurality of operator control devices 18 of identical configuration which can be manually operated by the user for stepless input of control commands. The operator control devices 18 each comprise a connecting element 20 and an input assembly 22. The input assembly 22 forms a preassemblable constructional unit which can be inserted into an upper-side recess 26 of the housing upper part 14 in a mounting direction shown in FIG. 7 by the arrow 24. The recess 26 is of circular cylindrical configuration and has a side wall upper section 28 which transitions via a radially inwardly directed step 30 to a side wall lower section 32 which is adjoined by a closed bottom wall 34.

The input assembly 22 comprises a hood-like, elastically deformable cover part 36 having a central cover opening 38 and a support ring 40. The support ring 40 is supported on an upper side 42 of a sleeve-like support part 44 which, at an underside 46 thereof facing away from the upper side 42, rests on the step 30, with a sealing ring 47 interposed therebetween. At the level of the underside 46, the support part 44 forms an intermediate wall 48 which, in a direction towards the bottom wall 34 of the recess 26, is adjoined by a guide sleeve 50. The guide sleeve 50 is arranged at a distance from the side wall lower section 32 and has its free end 52 assuming a distance from the bottom wall 34.

The intermediate wall 48 has a central wall opening 54 which is aligned in line with the cover opening 38. Supported on the intermediate wall 48 is a holding part 56 which is screwed together with the intermediate wall 48. The holding part 56 is configured as a hollow cylinder.

For input of a control command, the input assembly 22 has a flat pushbutton head 58 which rests on the cover part 36. Adjoining the pushbutton head 58 in rigid relation therewith is a plunger 62 which is oriented coaxially with respect to a longitudinal axis 64 of the input assembly 22 and which, at a lower end section 66 thereof facing towards the bottom wall 34, extends through the central wall opening 54 of the intermediate wall 48. Arranged at the lower end section 66 of the plunger 62 is a driver 68 which is configured in the form of a driver pin 70 oriented perpendicularly to the longitudinal axis 64 and which extends diametrically through the lower end section 66. The end portions 71, 73 of the driver pin 70 protruding in a radial direction from the lower end section 66 in each case enter a curve-shaped guide slot 72, 74 of a sleeve-like rotary member 76 which extends from the intermediate wall 48 in a direction towards the bottom wall 34.

The rotary member 76 is axially non-movably held to the guide sleeve 50 in relation to the longitudinal axis 64. To this end, the rotary member 76 has two holding slots 75, 77 in axially and circumferentially offset relation to the guide slots 72, 74, which holding slots 75, 77 extend in a circumferential direction with respect to the longitudinal axis 64 and into each of which enters a holding pin 79, 81 held to the guide sleeve 50 in stationary relation therewith.

On a side facing towards the bottom wall 34, the rotary member 76 has a circular cylindrical receptacle 78 in which a cylindrical permanent magnet 80 polarised laterally, i.e. transversely to the longitudinal axis 64, is held in a rotationally fixed manner. Associated with the permanent magnet 80 is a magnetic field sensitive sensor element 82 which is arranged below the bottom wall 34 on a circuit board 84 positioned in the housing 12 and which, via electrical connection lines known per se and therefore not shown in the drawing in the interest of clarity, is in electric communication with the control and transmission electronics, not illustrated in the drawing, of the operator control apparatus 10.

At an upper end section 86 of the plunger 62, a latch member 88 is fixed which, in the exemplary embodiment illustrated, is configured as a cylindrical latch sleeve 90. The latch sleeve 90 has the plunger 62 extending therethrough in a longitudinal direction. The plunger 62 is surrounded by a helical-shaped return spring 92 which is supported on the one hand on a radially inwardly directed collar 94 of the latch sleeve 90 and, on the other, on the intermediate wall 48.

As has already been mentioned, the input assembly 22 forms a preassemblable constructional unit which can be inserted into the recess 26 in the mounting direction 24. The connecting element 20, in the illustrated exemplary embodiment shown as being configured in the form of a union ring 96, is used for fixing the input assembly 22 in the recess 26. The union ring 96 surrounds the cover part 36 and the pushbutton head 58 in a circumferential direction and has an external thread 98 which can be screwed into a complementarily configured internal thread 100 which is arranged at the side wall upper section 28 of the recess 26.

For stepless command input, the user can actuate the pushbutton head 58 so that the latter, together with the plunger 62 and the latch sleeve 90, under elastic deformation of the cover part 36, is linearly displaced along the longitudinal axis 64 against the return force of the return spring 92. The linear movement of the plunger 62 is translated via the driver 68 and the curve-shaped guide slots 72, 74 extending in an axial and in a circumferential direction into a rotational movement of the rotary member 76 and the permanent magnet 80 fixed thereto. The axis of rotation of the rotary member 76 coincides with the longitudinal axis 64 of the input assembly 22. Actuating the pushbutton head 58 causes a change in the rotary position of the permanent magnet 80. The permanent magnet 80 is magnetised transversely to the longitudinal axis 64 so that a change in the rotary position of the permanent magnet 80 causes a change in the orientation of the magnetic field created thereby, relative to the longitudinal axis 64. The magnetic field extends through the bottom wall 34 so that its orientation can be detected within the housing 12 by the sensor element 82. The change in rotary position of the permanent magnet 80 caused by the stroke movement of the pushbutton head 58 is thus detected by the magnetic field sensitive sensor element 82, which then provides to the control and transmission electronics a sensor signal that depends on the rotary position of the permanent magnet 80. The control and transmission electronics generate a corresponding control signal which is transmitted to the device that is to be controlled.

In order to provide the user with tactile feedback on reaching predetermined stroke positions of the pushbutton head 58, the input assembly 22 has two latch elements 102, 104 in diametrically opposed relation to each other, which latch elements 102, 104 are held to the holding part 56 and each have a ball-shaped latch head 106 which is biased radially inwardly with respect to the longitudinal axis 64 by way of a latch spring 108. The latch elements 102, 104 are in each case associated with three latch depressions 110, 112, 114 which are arranged in a series one after the other in an axial direction on the exterior of the latch sleeve 90. When the plunger 62 is linearly moved by actuating the pushbutton head 58, the latch heads 106, in certain stroke positions which are predetermined by the location of the latch depressions 110, 112, 114, enter one of the latch depressions 110, 112, 114 and thereby give to the user tactile feedback on reaching the respective stroke position.

Figure 5:
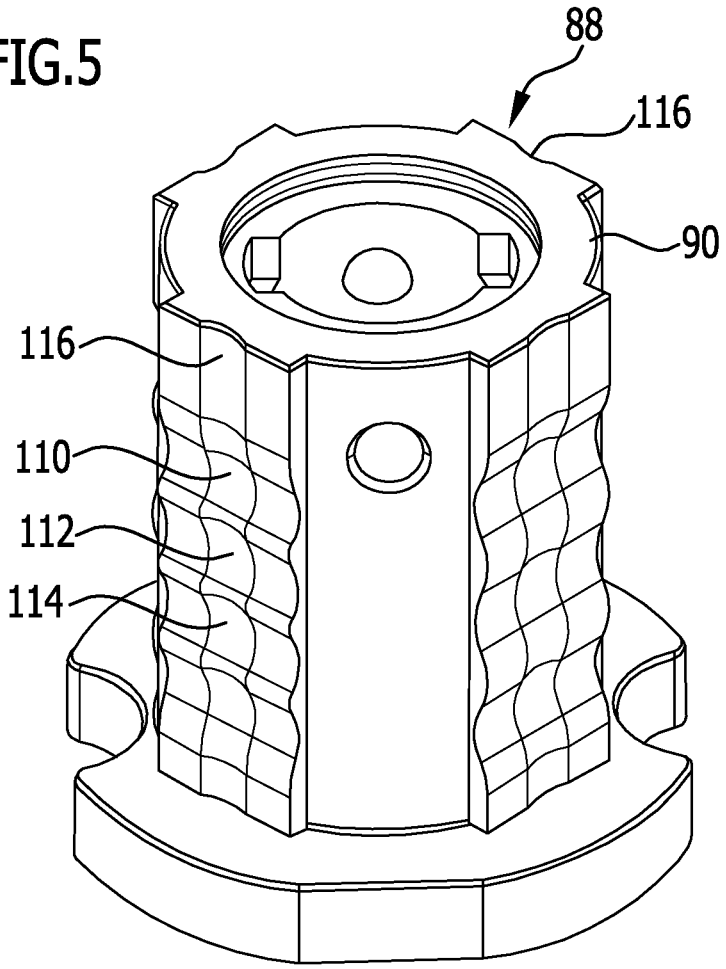
FIG. 5 is a perspective view illustrating a latch member of the operator control device of FIG. 4.
Figure 6:
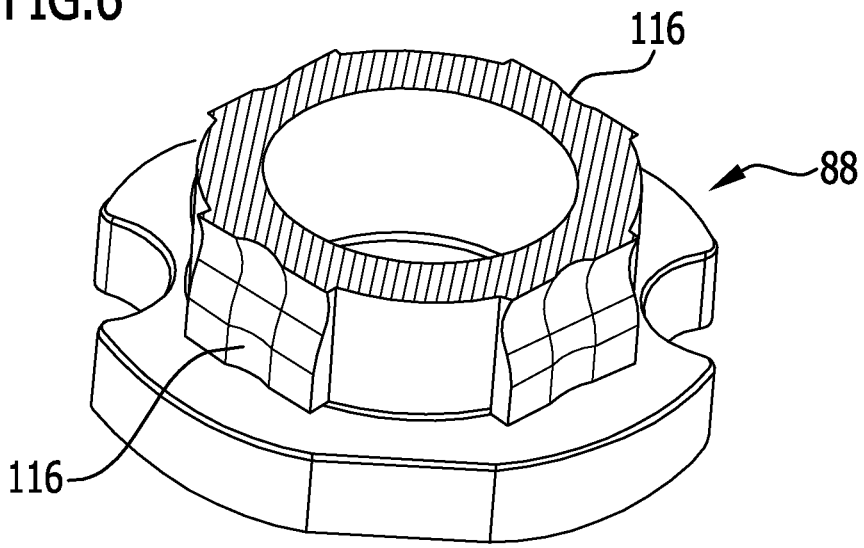
FIG. 6 is a sectional view of the latch member of FIG. 5.

As can be seen in FIGS. 5 and 6 in particular, the latch depressions 110, 112, 114 associated with each of the latch elements 102, 104 are integrally formed in a travel groove 116 which extends in an axial direction along the exterior of the latch sleeve 90. The shape of the travel groove 116, like the shape of the latch depressions 110, 112, 114, is adapted to the ball shape of the respective latch head 106 that enters them. With respect to the longitudinal axis 64 of the input assembly 22, the travel groove 116 has a concave, circular arc shaped surface contour in a circumferential direction and, in an axial direction, an undulating surface contour comprising ridges and latch depressions which succeed each other in the axial direction and along which the latch head 106 slides in line contact therewith when the pushbutton head 58 is moved and thereby provides to the user tactile feedback on reaching predetermined stroke positions when the pushbutton head 58 is actuated. Adapting the shape of the travel groove 116 and the latch depressions 110, 112, 114 to the shape of the latch head 106 prevents point loading of both the travel groove 116 and the latch depressions 110, 112, 114 caused by the latch head 106.

The operator control devices 18 are very easy to mount. As has already been mentioned, the respective input assembly 22 can be inserted as a preassembled constructional unit into one of the recesses 26 in the mounting direction 24. A union ring 96 can then be placed onto the input assembly 22 and screwed together with the housing 12. There is therefore no need to open the housing 12 for mounting the operator control devices 18. Should replacement of one or more input assemblies 22 be required at a later time, such replacement can also be realized without the need to open the housing 12. All that is necessary is to release the screwed connection of the union ring 96, and when this is done, the respective input assembly 22 may easily be removed from the recess 26.

What is claimed is:

1. An operator control apparatus, comprising:

a splashproof housing, at least one operator control device which comprises an input assembly having a pushbutton head adapted to be manually displaced along a longitudinal axis, a rotary member rotatable about an axis of rotation, and a coupling mechanism, a signal transmitter, and a sensor element arranged in the housing, wherein:

by way of the coupling mechanism, a linear movement of the pushbutton head is translated into a rotary movement of the rotary member, the signal transmitter is held to the rotary member in a rotationally fixed manner, the signal transmitter interacts with the sensor element, the input assembly is adapted to be inserted into an exterior recess of the housing and to be removed from the recess when required, the coupling mechanism comprises a plunger held to the pushbutton head, which plunger is coupled to the rotary member via a driver and a guide slot, the driver enters the guide slot, and the guide slot, relative to the longitudinal axis, extends in the shape of a curve in an axial direction and in a circumferential direction.

2. Operator control apparatus in accordance with claim 1, wherein the input assembly forms a preassembled constructional unit.

3. Operator control apparatus in accordance with claim 1, wherein the signal transmitter and the sensor element interact in a contactless manner.

4. Operator control apparatus in accordance with claim 1, wherein the signal transmitter is configured as a permanent magnet and the sensor element is sensitive to magnetic fields.

5. Operator control apparatus in accordance with claim 1, wherein the at least one operator control device comprises a connecting element surrounding the input assembly in a circumferential direction, which connecting element is adapted to be placed upon the input assembly and to be releasably connected to the housing.

6. Operator control apparatus in accordance with claim 5, wherein the connecting element is configured as a union ring which is adapted to be screwed to the housing.

7. Operator control apparatus in accordance with claim 1, wherein the exterior recess of the housing has a support surface and wherein the input assembly comprises a support part which is supported on the support surface.

8. Operator control apparatus in accordance with claim 7, wherein the support part forms a holder for the rotary member.

9. Operator control apparatus in accordance with claim 7, wherein the support part comprises a guide sleeve to which the rotary member is rotatably held.

10. Operator control apparatus in accordance with claim 1, wherein the input assembly comprises an elastically deformable cover part.

11. Operator control apparatus in accordance with claim 1, wherein the driver is held to the plunger in a rotationally fixed manner and the guide slot is arranged on the rotary member.

12. Operator control apparatus in accordance with claim 1, wherein the input assembly comprises at least one latch element having a latch head which has associated therewith at least one latch depression which the latch head enters when the pushbutton head has reached a predetermined stroke position.

13. Operator control apparatus in accordance with claim 12, wherein the at least one latch element has associated therewith a plurality of latch depressions arranged in a series one after the other relative to the longitudinal axis, which latch depressions the latch head enters successively when the pushbutton head is moved.

14. Operator control apparatus in accordance with claim 12, wherein the shape of the at least one latch depression is adapted to the shape of the latch head.

15. Operator control apparatus in accordance with claim 12, wherein:

the at least one latch element has associated therewith a travel groove oriented parallel to the longitudinal axis, the latch head of the latch element enters the travel groove permanently, and the at least one latch depression associated with the latch element is arranged in the travel groove.

16. Operator control apparatus in accordance with claim 15, wherein the shape of the travel groove is adapted to the shape of the latch head entering the travel groove.

17. Operator control apparatus in accordance with claim 16, wherein the latch head is of ball-shaped configuration and the travel groove has, relative to the longitudinal axis, a concave, circular arc shaped surface contour in a circumferential direction and, in an axial direction, an undulating surface contour comprising ridges and latch depressions which succeed each other in the axial direction and along which the latch head slides in line contact therewith when the pushbutton head is moved.

18. Operator control apparatus in accordance with claim 15, wherein the input assembly further comprises a latch member which is rigidly connected to the pushbutton head and which comprises the travel groove associated with each of the corresponding at least one latch element and comprises the at least one latch depression.

19. Operator control apparatus in accordance with claim 18, wherein the latch member is configured as a latch sleeve whose longitudinal axis is oriented coaxially with respect to the longitudinal axis of the input assembly and which carries on its exterior the travel groove associated with each of the corresponding at least one latch element and which is rigidly connected to the pushbutton head.

20. Operator control apparatus in accordance with claim 12, wherein the at least one latch element comprises two latch elements in diametrically opposed relation to each other, which latch elements are aligned in line with each other and whose latch heads are biased radially in a direction towards the longitudinal axis by way of return springs.

* * * * *